United States Patent [19]

Joly et al.

[11] Patent Number: 4,595,250

[45] Date of Patent: Jun. 17, 1986

[54] MODULAR APPARATUS FOR CODED INTERCONNECTION BETWEEN ELECTRONIC CARDS AND A PRINTED CIRCUIT BOARD

[75] Inventors: Jean Joly, Houilles; Yves Oehlert, Rueil, both of France

[73] Assignee: La Telemecanique Electrique, Nanterre, France

[21] Appl. No.: 691,520

[22] PCT Filed: Apr. 11, 1984

[86] PCT No.: PCT/FR84/00100

§ 371 Date: Dec. 6, 1984

§ 102(e) Date: Dec. 6, 1984

[87] PCT Pub. No.: WO84/04209

PCT Pub. Date: Oct. 25, 1984

[30] Foreign Application Priority Data

Apr. 15, 1983 [FR] France ..... 83 06176

[51] Int. Cl.[4] ..... H01R 9/09; H01R 13/64

[52] U.S. Cl. ..... 339/17 LM; 339/186 M

[58] Field of Search ..... 339/184 R, 184 M, 186 R, 339/186 M, 17 LM

[56] References Cited

U.S. PATENT DOCUMENTS

| | | | |
|---|---|---|---|
| 4,032,213 | 6/1977 | Snyder et al. | 339/186 M |
| 4,159,862 | 7/1979 | Funck et al. | 339/186 M |
| 4,398,779 | 8/1983 | Ling | 339/186 M |

FOREIGN PATENT DOCUMENTS

| | | | |
|---|---|---|---|
| 1969182 | 9/1967 | Fed. Rep. of Germany . | |
| 6605363 | 5/1970 | Fed. Rep. of Germany . | |
| 2144768 | 3/1973 | Fed. Rep. of Germany . | |
| 2416107 | 10/1975 | Fed. Rep. of Germany . | |
| 2534775 | 2/1977 | Fed. Rep. of Germany . | |
| 2541049 | 3/1977 | Fed. Rep. of Germany . | |
| 1389354 | 1/1965 | France . | |
| 1531972 | 7/1968 | France . | |
| 607542 | 12/1978 | Switzerland | 339/184 M |
| 1568189 | 5/1980 | United Kingdom | 339/186 M |
| 792386 | 12/1980 | U.S.S.R. | 339/186 M |

*Primary Examiner*—Neil Abrams

*Attorney, Agent, or Firm*—Young & Thompson

[57] ABSTRACT

Modular apparatus for coded interconnection between electronic cards and a printed circuit board, eliminates the risks of incorrect connection between a housing (9) containing a program card (8) and the bottom (1) of an auto-control container containing the printed circuit (4) and having rows of connections (6) for receiving male connections (7) arranged on one of the edges of the card (8) to connect them to the circuit (4). For each housing (9) and each row (6), the device comprises four rotary members (13, 16). The members (13) each carry a finger (17) which can engage in an orifice (18) in the members (16) when the angular positions between the members (13, 16) correspond to one another. The invention is used to make it easier to code the elements of a programmable auto-control.

15 Claims, 10 Drawing Figures

MODULAR APPARATUS FOR CODED INTERCONNECTION BETWEEN ELECTRONIC CARDS AND A PRINTED CIRCUIT BOARD

The present invention relates to a modular apparatus, such as an apparatus for the acquisition, processing and/or restitution of digital signals, of the type comprising programmable auto-controls, computers and industrial data-processing, instrumentation or transmission systems, incorporating electronic cards connected to a bus, particularly a printed circuit, by means of coded connections. The electronic cards can be, for example, central-unit cards, supply cards or input or output cards.

It is known that apparatuses of the programmable auto-control type are usually accommodated in a container, the bottom of which conceals a permanently installed printed circuit and has towards the interior of the container rows of connections, each of which is adapted to receive corresponding connections arranged at the edge of an electronic card mounted, for example, in a flat housing. The housings are arranged side by side in the container. The front face of at least some of the housings, which during operation is substantially in the plane of the aperture of the container, receives a terminal-box, by means of which the card is connected to an external central unit or to the members to be controlled or monitored.

The cards or their housings can be separated from the container. The readily understandable need has therefore arisen to prevent the possibility of mounting a given card or housing anywhere but in the location assigned to it in the container. Assembly and also work on repairs, tests or conversions of an existing apparatus are thereby made easier.

German utility model No. 6,605,363 discloses a mechanical coding device intended for preventing connection errors. According to this device, each of the two components to be connected possesses a comb. The teeth of each comb are directed towards those of the other comb. The teeth of the two combs are broken selectively, so that each remaining tooth is located opposite a broken tooth of the other comb.

This device has many disadvantages. The coding work is long and requires a high degree of attention. It is difficult to check. If a tooth is broken as the result of a coding error, the component has to be changed. Moreover, careful thought is needed to determine the codings which can be used in practice and those which should not be assigned. In fact, it is necessary to avoid the possibility of a device, the code of which consists of a relatively restricted number of remaining teeth, being connected to another device having a different code and possessing more broken teeth including those corresponding to the remaining teeth mentioned above.

German application No. 2,534,775 describes a device comprising, on the one hand, a comb with removable teeth and, on the other hand, a grid, of which the cells adapted to receive the teeth of the comb can be closed by means of attached plugs. Coding involves arranging the teeth on the comb according to a certain configuration and closing all the cells of the grid except those located opposite the teeth of the comb. This system has all the disadvantages of the device with breakable teeth, except that, in the second device, the coding errors can be rectified without waste.

German application No. 2,416,107 describes a third device which is specific to the apparatuses of the type covered by the invention and in which the housing carries teeth adapted to engagement in a profiled slide carried by the container. The profile of the teeth and that of the slide must match one another for the engagement of the housing to be possible. It is true that, during coding, there are no longer the difficulties and, where appropriate, the risks described with regard to the two known devices mentioned above. However, it is necessary, here, to make as many moulded teeth/slide pairings as there are different codes provided for all the equipment to be produced. This is very costly. Without special precautions at the design stage, there is even here the risk that relatively narrow teeth may be engaged incorrectly in a slide which is wider than them.

On the other hand, it is known from U.S. Pat. No. 4,032,213 to use an electrical connector, the male and female parts of which can be coupled only if coding members having mutually complementary shapes and installed permanently in suitable receptacles of the male and female parts, have been indexed in rotation to assume their positions of interaction.

Nevertheless, the male and female parts of such a connector have to be specially designed and manufactured. Moreover, the introduction of such connectors in a programmable auto-control entails a prohibitive cost price, since there must be a number of special connectors equal to the number of locations for the cards or card-carrying housings. Thus, the rows of connections on the printed circuit could not be standard elements and would also occupy a considerable space on the printed circuit.

The object of the invention is, therefore, to remedy the abovementioned disadvantages by proposing a coding device for a container receiving electronic cards, particularly for a programmable auto-control container, which is economical to produce and is coded easily and quickly.

The invention is thus directed to a modular apparatus comprising electronic cards associated removably with rows of connections carried by a bus supported by the bottom of a container, and a coding device to preventing the risks of connection errors between the rows of connections and series of contacts arranged at one edge of the electronic cards, this device comprising first coding members associated with the connection rows and second coding members associated with the electronic cards, the first and second coding members being capable of being individualized in such a way that a first and second coding member fit into one another when the row of connections and the card carrying them are suitable for being interconnected, and prevent any incorrect connection between a row and a card because fitting is impossible.

According to the invention, the apparatus is characterized in that the bottom of the container has an inner wall which is interposed between the bus and the electronic cards and which carries the first coding elements in the vicinity of the row of connections which is associated respectively with them, wherein the second coding members are carried by a wall associated with the card and directed, during operation towards the bottom of the container, and in that at least some of the first coding members are mounted displaceably relative to the inner wall between a series of positions, in each of which they can be fitted together with second coding members coded by means of corresponding positioning relative to the cards with which they are associated.

Thus, to code the elements of the apparatus, it is sufficient to displace the coding members of the various elements, in such a way that each coding member is in the position corresponding to the desired coding. The coding operation is therefore very rapid, errors can easily be rectified and, to carry out coding, it is not necessary to keep in stock a certain quantity of removable teeth or removable cell plugs or different slide combinations. Furthermore, there is no need for careful thought as to the codings which can be assigned and those which can not, since there is no risk that a coding member will be able to fit together with another member which does not have the corresponding coding. The coding members carried by the inner wall of the container bottom make it possible to use rows of conventional connections and do not encumber the bus. The forces exerted between coding members when they fit together are not transmitted to the bus.

The displaceable coding members can be displaced in translation from one predetermined position to another. However, they are preferably displaceable between different angular positions lockable relative to the element carrying them.

Coding can be made even easier when the first coding member has a means of actuation accessible from the front of the container of the auto-control.

The wall associated with the card and carrying the second coding member can consist of a right-angled piece attached to the card or of the rear face of a housing accommodating the card.

In an advantageous embodiment of the invention, the apparatus incorporates several first and second coding members displaceable for the coding of each connection.

Thus, each element of the auto-control can comprise at least one primary partial-coding member, determining whether it can intrinsically match another element coded in a corresponding way, and at least one secondary partial-coding member which determines the restriction on the connection possibilities as a function of the contingencies linked to the specific use of the apparatus.

If the example of the coding of the housings relative to the containers is taken again, the usefulness of the invention for the the few examples given below will be appreciated:

It is very often possible, according to choice, to mount on each row of connections of the container housings having different electronic cards. In the example of an output card to the apparatuses to be controlled, the output cards can differ in the currents which they make it possible to control. In the eyes of the designer of the auto-control, it does not matter whether the card connected to a given row of connections controls such and such a current. On the contrary, the auto-control designer wants to leave to the user the possibility of connecting, according to choice, a housing selected from a certain range to a given row of connections. The manufacturer of the elements therefore codes all these housings in the same way, and these housings are a priori interchangeable. However, this initial interchangeability usually disappears when the auto-control is integrated in a given installation. It is then no longer unimportant whether an output card controls a current of 1 ampere or 5 amperes.

In this case, the invention allows the user or the fitter to complete the coding of the card relative to the container, in such a way that, with the auto-control being assigned to a particular use, there can no longer be any transposition between cards which could have been transposed if there had only been the initial partial coding.

Moreover, it should be noted that the user or fitter may wish to particularize certain elements, for example strictly identical housings. For example, it is possible in a given installation for two identical cards to be associated with different terminal-boxes. By means of the second partial code, the user can complete the code of the card according to the type of terminal-box associated with it.

Other particular features and advantages of the invention will also emerge from the following description.

In the attached drawings given by way of non-limiting example:

Figure 1:
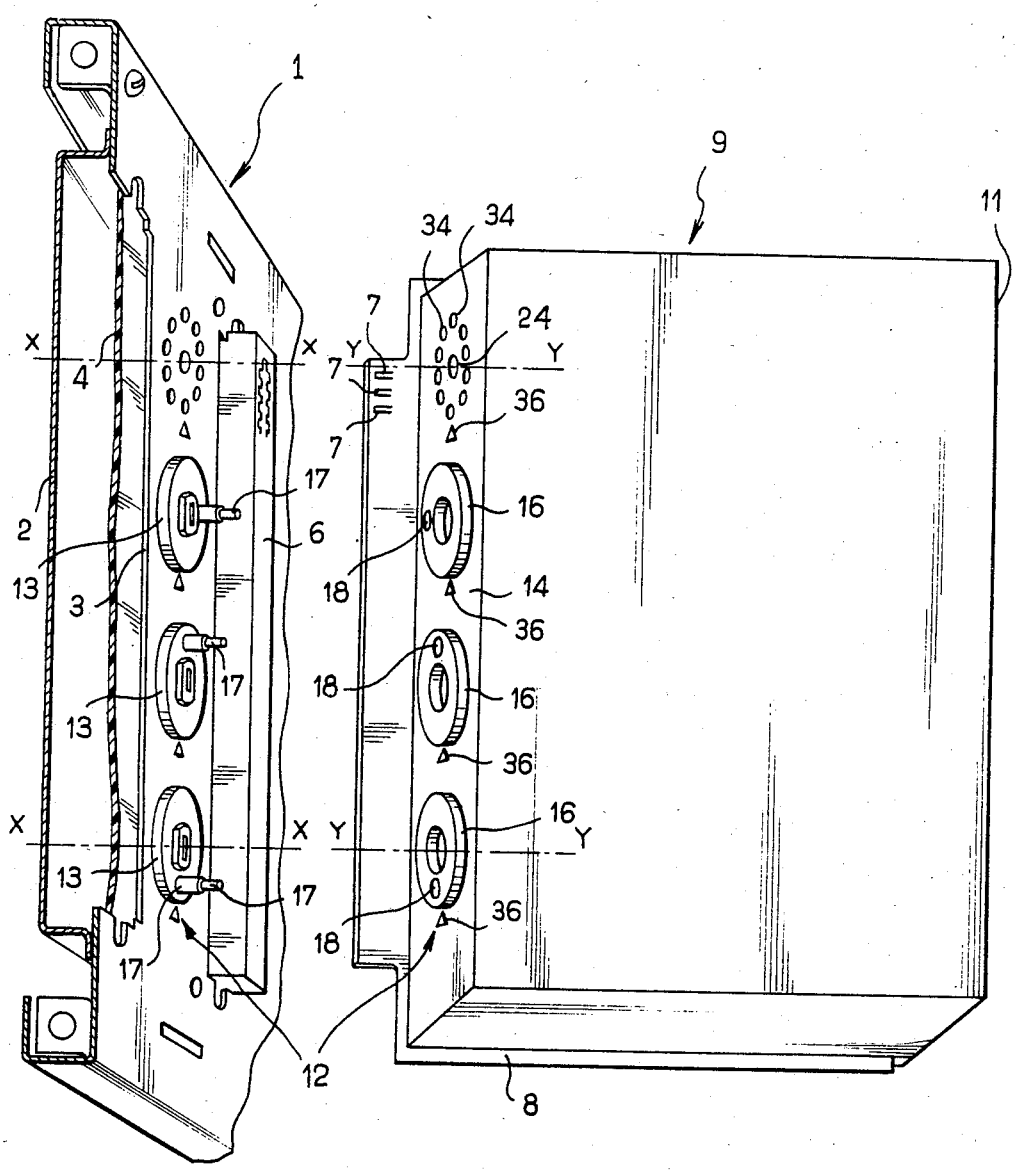
FIG. 1 is a partial perspective view of the bottom of the container of a programmable auto-control and of a housing intended for interacting with this bottom.

As shown in FIG. 1, a modular apparatus, such as a programmable auto-control, possesses a container, of which the bottom 1 which is shown alone comprises, an outer metal wall 2 and an inner metal wall 3, between which is mounted a printed circuit 4 acting as a connecting bus between rows of connections 6 that include insulative housing blocks and are fastened parallel to one another to the circuit 4. The rows of connections 6 project on the inside of the container via corresponding orifices made in the wall 3. In the bottom of the container there are means of stressing the circuit 4 towards the wall 3, on which it bears by means of shoulders (not shown) of the rows of connections 6. Each row 6 is intended for receiving a series of male contacts 7 arranged at the rear edge of an electronic card 8. Each electronic card 8 is mounted in a housing of flattened substantially parallelepipedic shape 9, made of synthetic material. The housings 9 are arranged side by side in the container, each opposite a row of connections 6. On their front face 11, the housings 9 can each receive a terminal-box (not shown), by means of which the electronic card 8 is connected, for example, to the members, the operation of which is to be monitored, if an input card is concerned, or to the members, the operation of which is to be controlled, if an output card is concerned. The card 8 can also be a connection card to a computing unit mounted directly on the front face 11 of the housing 9 or even at a distance from the container.

The housing 9 and the container bottom 1 carry a coding device 12 intended to prevent a housing 9, provided with a card 8 having specific functions, from being mounted on a row of connections 6 which, because of the points at which it is connected to the printed circuit 4, is not intended for receiving a card 8 of this type. The coding device 12 is of the mechanical type, comprising male and female members which fit into one another when they are coded in a corresponding way and when the housing 9 is brought towards the bottom of the container 1 so as to engage the contacts 7 in the row of connections 6.

Figure 2:
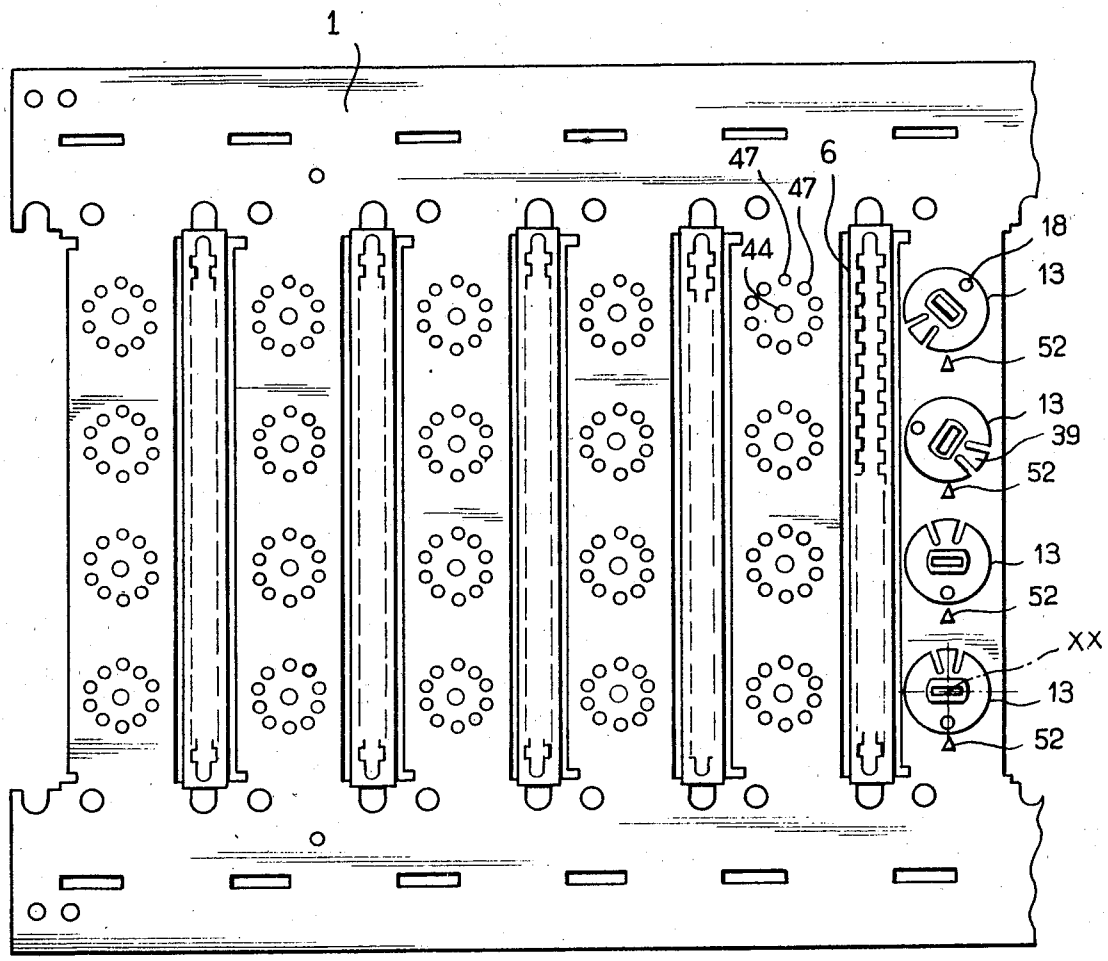
FIG. 2 is a plan view of the inner wall of the bottom of the housing.
Figure 3:
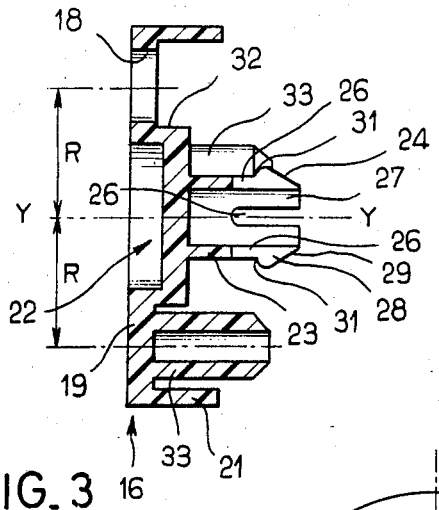
FIG. 3 is a view in axial section of a coding member intended to be mounted on the housing.
Figure 4:
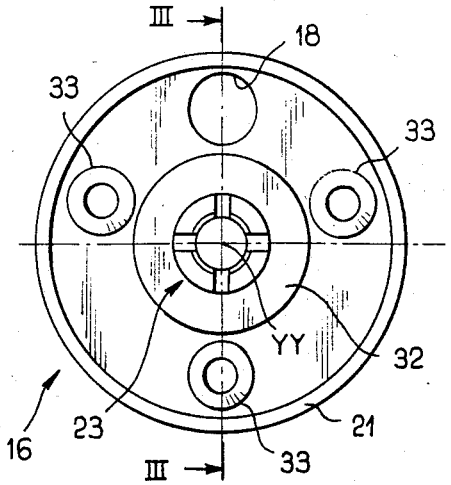
FIGS. 4 and 5 are plan views of the faces of this member which are respectively directed towards the housing and opposite this.

According to the invention, the inner wall 3 of the container bottom 1 carries, next to the row of connections 6 which they protect, four coding members 13 made of synthetic material, only three of which are shown in FIG. 1, but all four are shown in FIG. 2. In turn, the housing 9 has a rear face 14 which, during operation, is turned towards the bottom 1 of the container and which carries four female coding members 16, only three of which are shown in FIG. 1. Each male coding member 13 is located on the wall 3 in such a way that it can interact with a member 16 correspondingly positioned on the housing 9, and fit together with it if they are correspondingly coded, when the housing 9 is brought towards the bottom 1 in order to make the connection. All the male coding elements 13 are identical to one another, all the female coding elements 16 are identical to one another, and each male coding element 13 has a form which allows it to be fitted into any of the female coding members 16. Each coding member 13 or 16 is displaceable angularly, about an axis XX or YY respectively perpendicular to the wall 3 or 14 carrying it, between ten angular positions, the choice of which determines one of the four unit codes associated with the row of connections 6 or the housing 9 respectively. The male coding members carry, offset relative to the axis XX, a finger 17 parallel to the latter and pointed away from the wall 3. The female coding members 16 possess an orifice 18 which has relative to the axis YY the same offset as the finger 17 relative to the axis XX. When it is intended that a housing 9 should be made to match a given row of connections 6, the angular positions of the four coding members 16, which determine the four unit codes of the housing 9, and the four angular positions of the four coding members 13, determining the four unit codes of the row of connections 6, are made to correspond to one another. Thus, when the housing 9 is brought towards the container bottom 1 in order to introduce the rear edge of the card 8 into the row of connections 6, each of the fingers 17 is inserted into the orifice 18 of the coding member 16 coming opposite it. If at least one of the members 16 does not have an angular position corresponding to that of the member 13 opposite it, it is impossible to insert the card 8 into the row of connections 6.

Figure 9:
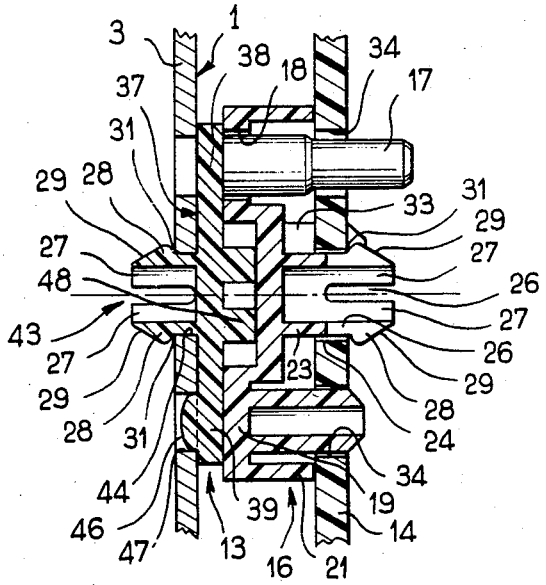
FIG. 9 is a view in axial section of the coding members of FIGS. 3 and 6 when they are coded in a corresponding way and are fitted together.

One of the coding members 16 carried by a housing 9 will now be described with reference to FIGS. 3 to 5 and 9. The coding member 16 made of synthetic material comprises a disc 19, the plane of which is perpendicular to the axis YY and the periphery of which is connected to a cylindrical collar 21 directed towards the wall 14 of the housing (FIG. 9). The disc 19 has at its centre a cylindrical recess 22 facing away from the wall 14. At the back of the recess 22, the disc 18 carries an axial lug 23 engaged in a perforation 24 passing through the wall 14. The lug 23 consists of a cylindrical wall having four axial slots 26 extending over a certain length from its free end. The four slots 26 distributed angularly define between them four tabs 27, each of which carries on its outer face a snap-in nose 28 which possesses, starting from the end of the lug, an engagement slope 29 and a disengagement slope 31. The distance measured parallel to the axis between that end of the slope 31 which is nearer to the disc 19 and the free end of the collar 21 is substantially equal to the thickness of the wall 14. Thus, during operation, the snap-in noses 28 are engaged behind the shoulder consisting of the inner face of the wall 14, without any elastic bending of the tabs 27, whilst the collar 21 is substantially in contact with the outer face of the wall 14.

A cylindrical boss 32 corresponds to the cylindrical recess 22 of the disc 19 on the opposite face of the latter. Between this boss and the collar 21, the disc 19 also carries three lugs 33 directed axially towards the wall 14. The axes of the lugs 33 are all three at the same distance R from the axis YY, and they extend axially beyond the collar 21 so that they can penetrate into a series of perforations 34 made through the wall 14 and distributed angularly about the axis YY (see also, in FIG. 1, the location of the fourth member 16 not illustrated). The distance between the axis of the perforations 34 and that of the perforation 24 is also equal to R. The angular distance separating the lugs 33 from one another is equal to the angular distance separating two adjacent perforations 34 or to a multiple of this. In the example illustrated, there are ten perforations 34 separated from one another by angular intervals of 36° from axis to axis, whilst on the member 16 one of the lugs 33 is separated from each of the other two by an interval of $3\times36°=108°$. Thus, there are ten angular positions (as many as there are perforations 34) in which the member 16 can be mounted on the wall 14, with each of the lugs 33 engaged in one of the perforations 34.

The axis of the orifice 18 through the disc 19 is likewise at the distance R from the axis YY and is likewise at an angular distance from the lugs 33 which is equal to the angular distance between two perforations 34 or to a multiple of this. In the example illustrated, the orifice 18 is diametrically opposite the lug 33 which is equidistant from the other two lugs 33. Thus, in each angular position of the member 16, the orifice 18 coincides with one of the perforations 34.

Figure 5:
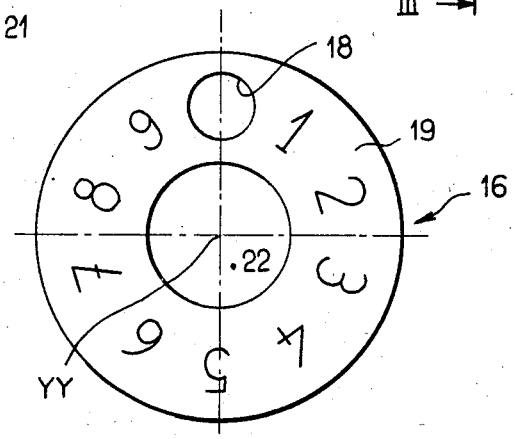
Figure 6:
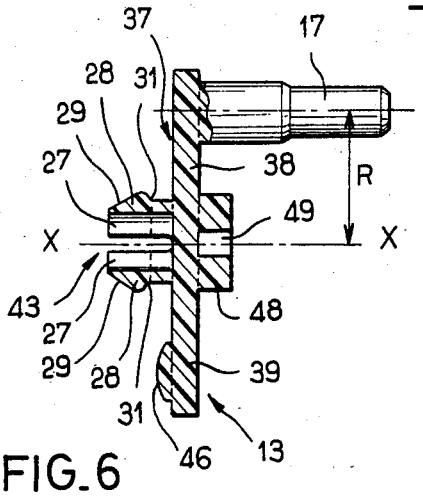
FIG. 6 is a view in axial section of a coding member carried by the bottom of the container.
Figure 7:
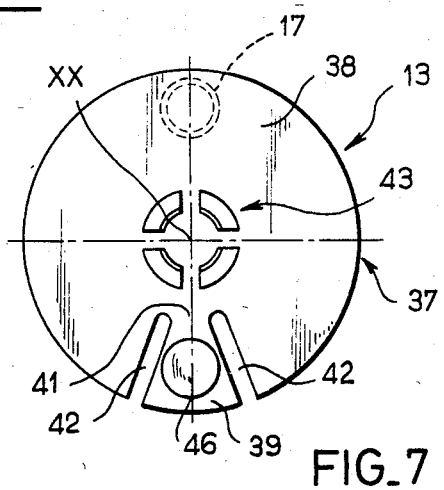
FIGS. 7 and 8 are plan views of the faces of the member of FIG. 6 which are respectively directed towards the bottom of the container and away from this latter.
Figure 8:
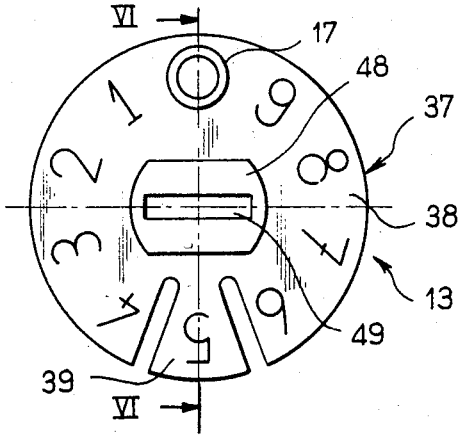

As shown in FIG. 5, the disc 19 carries on its outer face ten numerical reference marks 0 to 9 distributed angularly every 36°, the 0 being formed by the orifice 18. In each of the angular positions of the member 16 relative to the wall 14, one of the numerical reference marks is located opposite a fixed indicator reference mark 36 carried by the wall 14 in the vicinity of each member 16 (FIG. 1).

One of the coding members 13 carried by the bottom 1 of the container will now be described with reference to FIGS. 6 to 10. The member 13 comprises a plane disc 37 perpendicular to the axis XX, itself consisting of a main body 38 and a tab 39 connected to the body by means of an isthmus 41 defined between the bottom of two notches 42. These extend radially on either side of the tab 39 from the periphery of the disc 37. The notches 42 have a certain circumferential dimension, so that the tab 39 has a certain elasticity in the circumferential direction relative to the body 38 of the disc 37. Furthermore, the width and thickness of the isthmus 41 are small enough to ensure that the tab 39 can bend elastically in the direction of disengagement of the lug 46, moving away from the plane of the disc 37. On its face directed towards the bottom 1 of the container, the body 38 carries at the center of the disc 37 a lug 43 which is identical to the lug 23 of the members 16, except that it is shorter than the latter, since the disc 37 bears against the bottom 1 of the container directly and not by means of a collar, such as 21. During operation, the lug 43 directed along the axis XX is engaged in a perforation 44 (FIGS. 1, 2 and 9), and its snap-in noses 28 are engaged behind the shoulder consisting of the inner face of the wall 3, without any bending of the tabs 27.

The tab 39 carries, on its face directed towards the bottom 1 of the container, a lug 46 which, during operation, is engaged in any one of a series of ten perforations 47 made through the wall 3 of the container at locations distributed angularly about the axis XX. The finger 17 is fastened to the outer face of the body 38 of the disc 37 in a position diametrically opposite the lug 46. The axis of the finger 17 is at the distance R from the axis XX. Moreover, the angular position of the perforations 47 about the axis XX is such that, when any one of them is occupied by the lug 46, the finger 17 is located opposite one of the perforations 34 made in the wall 14 of a housing 9 assumed to be brought towards the bottom 1 of the container so that its card 8 is introduced into the particular row of connections 6. As shown in FIG. 9, if the codings of the members 13 and 16 correspond to one another, the orifice 18 coincides with the perforation 34, opposite which the finger 17 is located, and after connection the finger 17 is engaged in the orifice 18 and in the perforation 34 with which it coincides. The length of the finger 17 is such that, when the codings of the members 13 and 16 do not correspond, the finger 17 coming in abutment against the disc 19 of the member 16 prevents the advance of the housing 9 towards the bottom of the container 1 sufficiently to ensure that the card cannot encounter the contact elements of the row of connections 6 at all.

Figure 10:
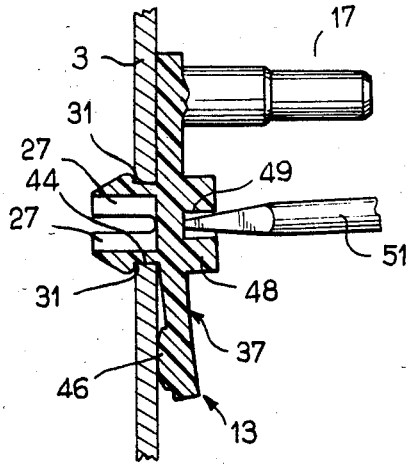
FIG. 10 is a view in axial section of the coding member of FIG. 6 during the coding operation.

The body 38 of the disc 37 also carries, in a central position on its outer face, a boss 48 which is received in the recess 22 of the member 16 when the members 13 and 16 are fitted into one another. The boss 48 has a slot 49 for the insertion of a screwdriver 51 (FIG. 10). Moreover, the lug 46 (FIGS. 6 and 10) has a cylindrical base with a very small axial dimension, so that it does not occupy the entire thickness of the perforations 47. The end of the lug 46 is convex.

There will now be a description of how the coding device just described is used.

Four members 13 are mounted next to each row of connections 6, as shown for one of the rows in FIG. 2. A screwdriver 51 (FIG. 10) is subsequently inserted into the slot 49 of each member 13, and a rotational force is exerted on the member 13 by means of the screwdriver 51. Because of the small height of the lug 46, this force is sufficient to extract the lug 46 from the perforation 47 as a result of bending of the tab 39 relative to the disc 37 in the direction of disengagement of the lug 46. The disc 37 can contribute to this disengagement of the lug 46 by being detached slightly from the wall 3 as a result of the penetration of the disengagement slopes 31 into the perforation 44 and slight closure of the ring consisting of the four tabs 27. This wall has an indicator reference mark 52 next to each member 13. Thus, any coding is characterized by a four-digit number, and to carry out the coding it is sufficient to give each member 13 such an angular position that the numerical reference mark located opposite the indicator reference mark 52 corresponds to a particular digit of the code.

The housings 9 are subsequently coded in a corresponding way by snapping in the member 16 at the four locations provided. Each member 16 is snapped directly into such an angular position that the digit located opposite the associated reference mark 36 is the same as the digit selected by means of the corresponding member 13 associated with a row of connections 6 designed to receive the particular housing 9. In fact, the procedure is such that, when the same digit is selected for two members 13 and 16 positioned so that they can interact, the finger 17 of the member 13 is opposite the orifice 18 of the member 16. To change the code of a housing 9, it is necessary to extract the members 16 which are not set at the right digit and snap them into the new angular position again. Extraction can be carried out from outside the housing 9 by means of the disengagement slopes 31 of the snap-in noses 28 of the lug 23. It will be noted, however, that it has deliberately been made relatively difficult to modify the code of the housings 9, since each housing 9 contains a specific card 8 with which it is expedient to associate an invariable code.

Because of the circumferential elasticity of the tabs 39, the members 19 can, if required, undergo a slight angular displacement during fitting into the orifices 18.

According to the invention, the complete four-digit code of each row of connections 6 or of each housing 9 incorporates a partial two-digit code (the two at the top in FIG. 2) which is formed at the factory and which is intended to make it possible to plug into the row of connections 6 only cards 8 which are intrinsically compatible with these. The four-digit code also incorporates a second partial code which is left available to restrict the connection possibilities further according to the particular use made of the programmable auto-control. At the factory, this second partial code is the same for all the rows of connections 6 and all the housings 9. This second partial code is "00" in the example illustrated, when it leaves the factory. As regards the housings 9, rather than precode the second partial code to "00" at the factory, it is possible to supply separately two coding members 16 which the user can snap into the position corresponding to the second partial code desired.

It has thus been possible to see throughout the description that the coding device according to the invention considerably simplifies the coding operations, eliminates both the components to be broken and the additional components to be kept in stock and prevents any possibility of connection if the codes are different. Furthermore, it is particularly simple to produce the container bottom and assemble the first coding members.

The invention also offers the user the unprecedented, but particularly interesting possibility of completing the coding as a function of data external to an apparatus of the auto-control type.

Of course, the invention is not limited to the examples described and illustrated, and many modifications can be made to these examples, without departing from the scope of the invention.

Thus, in particular, the coding members could consist of notched sliders, one carrying a finger which can engage in an orifice in the other when the codings correspond to one another.

In the vicinity of the rows of connections 6 which can receive only one highly specific card 8, such as a supply card, it is possible to use male coding members which can be associated with the wall 3 in the way in which the coding members 16 are associated with the wall 14, this being to prevent the user from disarranging this code.

We claim:

1. A card receptacle for removably receiving electronic cards and making connections between them and a printed circuit board, said card receptacle comprising:

a container carrying behind an inner bottom wall (3) thereof a said printed circuit board (4), said printed circuit board carrying connectors (6) extending from the printed circuit board through apertures in said inner bottom wall, said connectors (6) each providing a row of electrical connections within insulative housing blocks that extend through said apertures:

electronic cards (8) in the container carrying on one edge thereof contacts (7) insertable into the connectors (6);

coding devices, each comprising at least one first coding member (13) carried by said inner bottom wall adjacent a respective one of said connectors and directly between a pair of said apertures and at least one second coding member (16) operatively attached to a corresponding one of said electronic cards; and means mounting at least some of the first coding members (13) displaceably relative to the inner wall (3) between a series of positions, in each of which they can be fitted together with the second coding members (16) coded by means of a corresponding positioning relative to the cards (8) to which they are attached when the contacts of the cards are inserted in the rows of connections.

2. A card receptacle as claimed in claim 1, wherein the first and second coding members (13, 16) are displaceable between different angular positions in which they are lockable with respect to the inner bottom wall (3) and one said card (8) respectively.

3. A card receptacle as claimed in claim 1, wherein each displaceable first coding member (13) has a means of actuation (49) accessible from inside the container.

4. A card receptacle as claimed in claim 1, wherein the second coding members (16) are displaceably mounted in a rear face of housings (9) containing the cards (8).

5. A card receptacle as claimed in claim 1, wherein each connector (6) and each card (8) are associated respectively with several first and second coding members (13, 16) which are aligned respectively parallel to the rows of said connectors (6) and of said contacts (7).

6. A card receptacle as claimed in claim 2, wherein the second coding members (16) are carried by walls attached to the electronic cards (8), each displaceable coding member (13 or 16) comprises at least first and second positioning lugs, and at least said first lug is, for code selection purposes, selectively insertable in a series of perforations in the wall carrying said coding member.

7. A card receptacle according to claim 6, wherein said walls carrying said coding members and at least one of said lugs of each coding member have snap fastener means for retaining the coding members against the walls.

8. A card receptacle according to claim 7, wherein said snap fastener means are carried by the second lugs (23, 43), and wherein at least some of the coding members are adapted to rotate about their second lug upon limited extraction thereof while the first lug passes from one perforation to the other.

9. A card receptacle as claimed in claim 6, wherein the second lug (23, 43) is on the axis of rotation (XX, YY) of the corresponding coding member (13, 16).

10. A card receptacle as claimed in claim 1, wherein the second coding members are carried by walls attached to the electronic cards (8), and wherein one of the first and second coding members of each coding device comprises on the one hand a positioning lug which is selectively insertable in one of a series of perforations in the wall carrying said coding member, and on the other hand a hole registering with a said perforation of said series when the positioning lug is itself inserted in a said perforation, and wherein the other of the first and second coding members of each coding device carries a finger which, when the first and the second coding members are correspondingly coded, fits into the hole and into the perforation which registers therewith.

11. A card receptacle as claimed in claim 6, wherein the first lug of at least some of the coding members is mounted for limited elastic circumferential movement with respect to a body of said at least some of the coding members, said body being adapted to fit with a complementary, correspondingly coded coding member.

12. A card receptacle as claimed in claim 6, wherein said first lug of at least some of the coding members is mounted for being self-retractable out of the series of perforations upon a force being applied to said at least some of the coding members in a circumferential direction.

13. A card receptacle according to claim 12, wherein said at least some of the coding members comprise a body and a tab (39) carrying the first lug and connected to the body by a flexible portion (41).

14. A card receptacle as claimed in claim 1 wherein each connector (6) or each card (8) to be coded is associated with at least one primary partial-coding member, determining whether said connector (6) or said card (8) can be intrinsically associated with another card or connector, and at least one secondary partial-coding member which limits the connection possibilities according to predetermined requirements for the use of the circuit board.

15. A card receptacle as claimed in claim 14, wherein all the secondary partial-coding members are preset in a same predetermined position.

* * * * *